United States Patent [19]

Firth

[11] Patent Number: 4,919,034

[45] Date of Patent: Apr. 24, 1990

[54] MINE CLEARING APPARATUS

[76] Inventor: Charles B. Firth, Aston Works, Bramley, Leeds LS13 2BY, England

[21] Appl. No.: 365,534

[22] Filed: Jun. 13, 1989

[51] Int. Cl.[5] ..... F41H 11/12

[52] U.S. Cl. ..... 89/1.13; 172/815; 172/825

[58] Field of Search ..... 171/141; 172/815, 825, 172/828, 833, 832, 460; 89/1.13

[56] References Cited

U.S. PATENT DOCUMENTS

| | | | |
|---|---|---|---|
| 2,486,372 | 10/1949 | Rockwell | 89/1.13 |
| 2,632,264 | 3/1953 | Rhyno et al. | 172/832 |
| 2,891,334 | 6/1959 | Kinzer | 172/815 |
| 3,429,381 | 2/1969 | Lauder et al. | 172/815 |
| 3,604,517 | 9/1971 | Clifford | 172/825 |
| 4,074,448 | 2/1978 | Niemla | 172/815 |
| 4,311,200 | 1/1982 | Lebedev et al. | 172/815 |
| 4,552,053 | 11/1985 | Bar-Nefy et al. | 89/1.13 |
| 4,552,226 | 11/1985 | Platter | 172/815 |
| 4,590,844 | 5/1986 | Bar-Nefy et al. | 89/1.13 |

FOREIGN PATENT DOCUMENTS

| | | | |
|---|---|---|---|
| 894565 | 10/1953 | Fed. Rep. of Germany | 172/815 |
| 479856 | 11/1975 | U.S.S.R. | 172/815 |
| 2149357 | 6/1985 | United Kingdom | 89/1.13 |

*Primary Examiner*—David H. Brown
*Attorney, Agent, or Firm*—Neal J. Mosely

[57] ABSTRACT

A mine clearing apparatus for mounting onto a vehicle, the apparatus comprising a support adapted to be rigidly fixed to the vehicle and at least one elongate plough blade extending transversely of the path of forward travel of the vehicle and mounted on the support in such a way that the or each blade is pivotable about a first axis which extends transversely of said path and characterized in that said plough blade is pivotable also about a second axis which extends substantially perpendicular to said first axis and approximately or generally parallel to the path of travel of the vehicle.

10 Claims, 2 Drawing Sheets

MINE CLEARING APPARATUS

BACKGROUND TO THE INVENTION

This invention relates to mine clearing apparatus in the form of an attachment for mounting on the front of a vehicle and intended for clearing mines lying on the ground, close to the ground surface, or deep-laid mines.

The invention has been developed primarily in relation to a front mounted attachment for an armoured car, personnel carrier or tank, although it should be appreciated that the attachment may be mounted on any other suitable vehicle to be used for clearing mines.

In this specification, the reference to the "front" of a vehicle is intended to refer to the leading end of a vehicle with respect to its normal direction of travel. Thus, in some cases, this may be what would otherwise be regarded as the rear end of the vehicle.

One known apparatus of this type is disclosed in EP 0094901 and comprises a pair of plough blades which are mounted on a support frame fixed to the front of an armoured vehicle. The plough blades can be raised or lowered together, but when in the lowered, operative position any inclines of hummocks in the ground either cause the edge of the blade to dig deeper than is necessary, with consequent increase in draft force, or it may cause it to be higher than desirable, with the risk of not clearing any mines which may be present. This means that full use is not made of the available draft force of the vehicle. This type of apparatus also suffers from the disadvantage that there is a central space defined between the inboard ends of each plough blade, and this gives rise to an unploughed region between the blades, and which corresponds to the central region of the vehicle where the armour is usually thinnest, and particularly the vulnerable underside of the vehicle.

A further feature of the known apparatus is that the plough blades are only pivoted about a single axis, which extends perpendicular to the general path of travel of the vehicle, and there will be occasions in service, when the apparatus is operating over very uneven ground, but the blade is not able to position itself at an optimum position with respect to the ground surface and there is a substantial risk that a particular trough or depression in the ground surface may be uncleared by the plough as it travels over or at least partly through the upper surface of the ground, with resultant risk of exposure of the following vehicle to the action of an uncleared mine in the hollow. This problem could be attempted to be overcome by lowering the plough so as to dig deeper into the ground surface, but this will result in a very considerable increase in requirement for draft force which utilizes more power from the vehicle, and also slows down the clearing operation.

Given that the blades in the known apparatus are pivotable about a single axis, it is necessary to attach skids to the blades, in order to control the depth of the blades, and particularly the tines carried thereby, relative to the ground surface. The known apparatus is usually mounted on the front of a heavy AFV (armored fighting vehicle), and because of the difference in distance away from the pivot of the tines at the leading end of the blade, as compared with the distance of the tines at the rear end of the blade, raising the front tines by, say, one inch, causes the rear tines to be raised through a smaller distance, say three quarters of an inch. However, the depth of the tines, compared to the undulations commonly found and the relative differences in heights generally means that this is not too much of a problem for deep working tines.

However, for full width clearance of, for example, scatterable mines, where the blades extend transversely to cover the center of the path to be cleared, and the tines are not intended to extend so deeply into the ground surface, the undulations encountered may be generally the same, but the ratio of the distance of the tines at the leading end from the pivot to the distance of the rear tines from the pivot, compared to the reduced depth of clearance provided with lighter vehicles, makes the single pivot arrangement less attractive.

To enable the mine clearing apparatus to be lifted out of contact with the ground, when mine clearing is not required e.g. for normal travel of the vehicle to which the apparatus is attached, preferably a winch is mounted on the vehicle, and is connected by a hauling cable to any convenient hitch point on the apparatus, so as to pivot the entire apparatus upwardly about said first axis.

The present invention therefore seeks to overcome the limitations of the known apparatus by providing a pivot axis for the or each blade which extends approximately parallel to the intended direction of travel.

SUMMARY OF THE INVENTION

According to the invention there is provided a mine clearing apparatus in the form of an attachment for mounting on the front of a vehicle, the apparatus comprising a support adapted to be rigidly fixed to the vehicle front and at least one elongate plough blade extending transversely of the path of forward travel of the vehicle and mounted on the support in such a way that it is pivotable about a first axis which extends transversely of said path and also about a second axis which extends substantially perpendicular to said first axis and approximately or generally parallel to the path of travel of the vehicle, whereby the pivoting of the blade about said first and second axes serves to enable the plough blade to be moved into and to be maintained in the optimum position with respect to the ground surface to ensure a substantially uniform clearance of mines along the length of the blade.

The apparatus may have a single blade, but in a preferred embodiment has two blades, each being independently pivotable about said first axis and about a respective second axis.

Preferably, each plough blade is curved and is inclined away from the direction of travel of the vehicle so that the cleared mines are pushed aside, away from the path of the vehicle. Each plough blade may include racking tines which extend below its lower edge, the purpose of these being to dig into the ground to lift buried or partially buried mines.

Conveniently, the two plough blades together extend beyond the full width of the vehicle.

The support by means of which the two plough blades can be attached to the front of the vehicle preferably comprises a central mounting portion, to the lower end of which said blades are connected so as to extend generally outwardly therefrom, and a four arm type pivotal linkage for connecting the central mounting portion to a mounting plate or block attachable to the vehicle front.

The four arm linkage has an upper link forming a yoke which is pivotally connected to the upper end of the central mounting portion, and a lower link extending between the mounting plate or block and a lower region of the central mounting portion, and nearly parallel to the upper link. The arrangement of the upper and lower links is such that prolongations of the axes of the upper and lower links intersect at a position a substantial distance rearwardly of the blades, thereby forming an instantaneous center of rotation (ICR) which is the effective center of rotation about which the central mounting portion (and the blades carried thereby) is pivotable.

By creating an instantaneous center of rotation in such a position, the resulting forces applied to the vehicle during ground engagement by the plough blades are such as to minimize any detrimental effect the forces would have on the vehicle and the attitude created by the suspension.

Preferably, the central mounting portion takes the form of a generally conical mounting assembly, the apex of the cone being connected to the upper link type yoke, whereas the lower link associated with each blade is pivotally connected to the conical assembly adjacent its bottom end, and such that the connections of the lower linkages are spaced apart from each other in a direction substantially perpendicular to the intended direction of travel.

Each plough blade is also pivotally attached to a lower portion of the conical assembly by means of a pair of spaced apart pivots which are arranged, with respect to the longitudinal axis of the vehicle, such as to define for each blade said second axis, which extends at a small inclination to the longitudinal axis and the intended direction of travel of the vehicle.

Preferably, one of the blades extends laterally inwards from its outer end so as to overlap the longitudinal axis of the vehile, and the other blade is arranged rearwardly of this blade and extends laterally inwards from its outer end so as to be close to, but not overlapping the longitudinal axis. This arrangement of plough blades ensures that there is an uninterrupted mine engaging capability extending continuously throughout the width of at least the vehicle, and preferably laterally to either side thereof by any desired amount.

The foremost plough blade, which overlaps the longitudinal axis, is preferably provided with a ground engaging skid or wheel at each end thereof, whereas the other plough blade need only be provided with a ground skid or wheel at its laterally outer end.

BRIEF DESCRIPTION OF THE DRAWINGS

One embodiment of mine clearing apparatus according to the invention will now be described in detail, by way of example only, with reference to the accompanying drawings, in which.

DESCRIPTION OF THE PREFERRED EMBODIMENT

Figure 1:
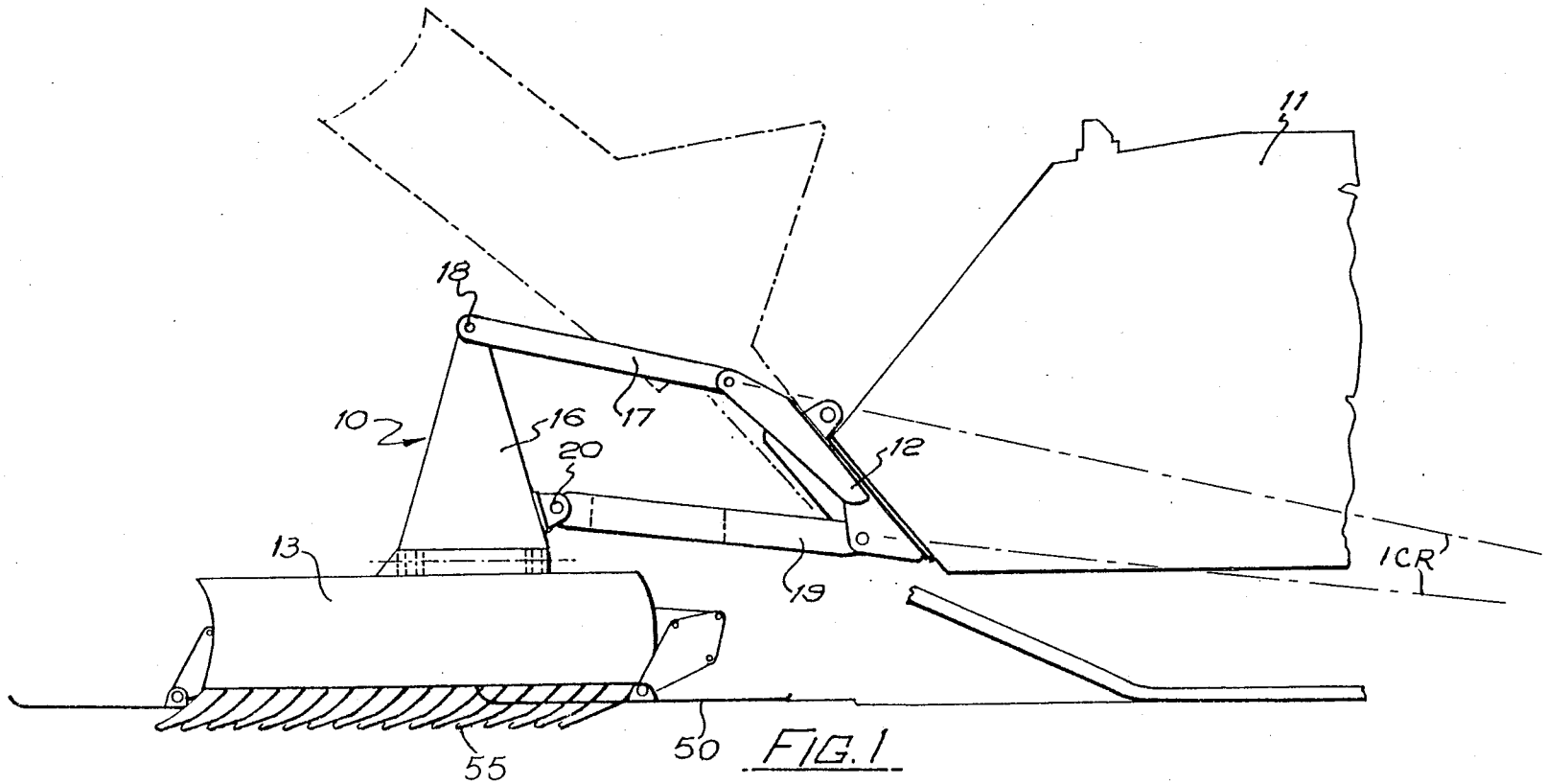
FIG. 1 is a side view of the apparatus mounted at the front end of a mine clearing vehicle.

Referring now to the drawings, mine clearing apparatus according to the invention is designated generally by reference 10 which takes the form of an attachment for mounting on the front of a vehicle 11, the apparatus 10 comprising a support in the form of a mounting plate or block 12 which is rigidly fixed to the front of the vehicle 11, and a pair of elongate plough blades 13 and 14 which extend transversely of the path of forward travel (which will be the same as the longitudinal axis 15 of the vehicle). It will be seen from FIG. 2 that the plough blade 13 extends laterally inwardly from its outer end by a distance so as to overlap the longitudinal axis 15, whereas the plough blade 14, which is located rearwardly of the plough blade 13, only extends inwardly from its laterally outer end to a position closely adjacent to the axis 15, and immediately behind the leading end of the plough blade 13.

The foremost plough blade 13 overlaps the longitudinal axis 15 and is provided with a ground engaging skid or wheel 50 of adjustable height at each end thereof. The rearward plough blade 14 is provided with a ground skid or wheel 52 only on its outer end.

Each of the plough blades 13, 14 are provided with a row of tines 55 along their lowermost edge.

The plough blades 13 and 14 are attached to a central mounting portion 16 which is a generally conical shaped assembly, and each blade extends generally outwardly therefrom. In addition, a four arm type pivotal linkage connects the central mounting portion 16 to the mounting block 12, and comprises an upper structure 17 which forms a yoke 18 attached to the upper end of the mounting portion 16, and a lower structure 19 which is pivotally connected to a lower region of the mounting portion 16 on pivots 20 which, as seen in FIG. 2, are spaced apart from each other in a direction substantially perpendicular to the axis 15.

The prolongations of the axes of the links forming the upper structure 17 and lower structure 19 intersect at a substantial distance to the rear of the blades, and also rearwardly of the front of the vehicle 11, and this point of intersection is known as the instantaneous center of rotation (ICR). This forms the effective pivot point for the central mounting portion 16, about which it can be considered to pivot, when it is raised and lowered with respect to the front of the vehicle. By creating such an ICR, the resulting forces acting on the vehicle, as a result of a mine clearing operation, are such as to minimize any detrimental effect the forces may have on the vehicle, or its attitude created by its suspension.

Figure 2:
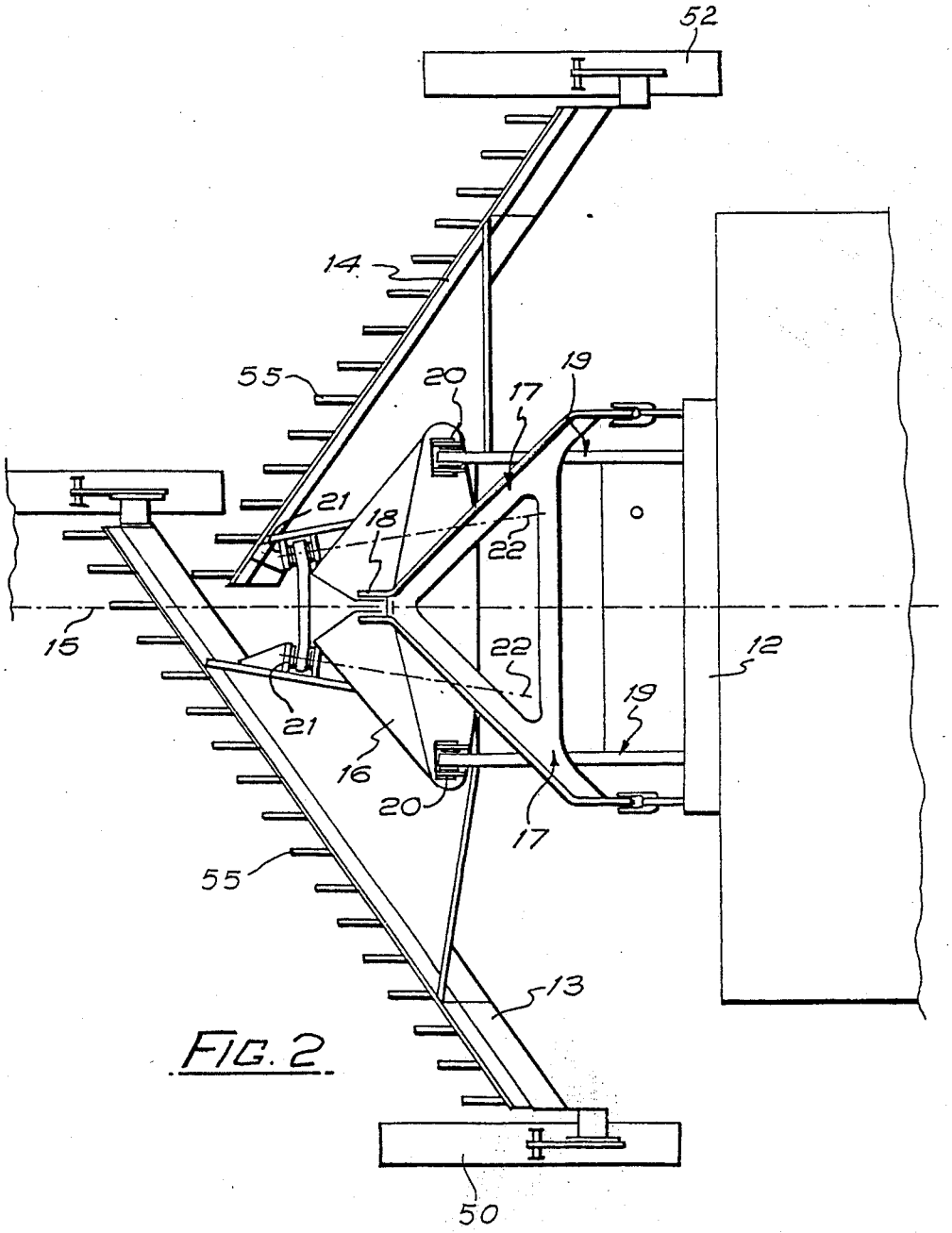
FIG. 2 is a plan view of the apparatus.

As can also be seen in FIG. 2, each blade 13 or 14 is pivotally connected to a lower portion of the conical type mounting assembly 16 by means of a pair of spaced apart pivots, one of which is shown by reference 21, and which define substantially horizontal pivot axes 22 which are only slightly inclined i.e. approximately parallel to the longitudinal axis 15. The pivot axes 22 permit the blades 13 and 14 to move up and down in a lateral plane i.e. laterally of the longitudinal axis 15, in order to adjust themselves to any varying surface terrain.

When the apparatus 10 is no longer required for a particular mine clearing operation, it can be raised to a transport position, as shown in dashed outline in FIG. 1, by means of a small winch (not shown) mounted on the front end of the vehicle 11 and connected by a cable to a suitable hitch point on the apparatus.

I claim:

1. Mine clearing apparatus for mounting on a vehicle, said apparatus comprising a support, adapted, in use, to be supported on a vehicle, first and second elongate plough blades, means mounting said blades pivotally on said support such that each of said blades, in use, extends generally transversely of the path of travel of said vehicle in forward and rearward spaced relation to each other along said path of vehicle travel, said forward blade overlapping said path of vehicle travel, and said rearward blade terminating close to said path of vehicle travel and overlapping said forward blade, said blade pivotal mounting means including means permitting pivotal movement of each blade about a first axis extending transversely to said path of vehicle travel and a second axis substantially perpendicular to said first axis and parallel to said path of vehicle travel.

2. Mine clearing apparatus according to claim 1 in which said forward blade includes ground-engaging travel means at each end thereof, and said rearward blade includes ground-engaging travel means only at its laterally outward end.

3. Mine clearing apparatus according to claim 2 in which said ground-engaging travel includes at least one wheel.

4. Mine clearing apparatus according to claim 2 in which said ground-engaging travel includes at least one skid.

5. Mine clearing apparatus according to claim 1 in which said pivotal movement means includes a central mounting portion, a mounting block attachable to the front of said vehicle, and a four-arm-type linkage connecting said central mounting portion to said mounting block.

6. Mine clearing apparatus according to claim 5 in which said four-arm-type linkage has an upper link and a lower link, means pivotally connecting said upper link to an upper end of said central mounting portion to form a yoke, and means mounting said lower link to extend between said central mounting portion in substantially parallel relation with said upper link mounting portion, the axes of said upper and lower links intersecting at a point rearward of said blades.

7. Mine clearing apparatus according to claim 15 in which said central mounting portion comprises a generally conical mounting assembly, upper link mounting means connecting said upper link to the apex of said conical mounting assembly, said apparatus having a pair of said lower links, said lower link mounting means connecting said lower links to said conical mounting assembly adjacent its lower end in laterally spaced relation relative to said path of vehicle travel.

8. Mine clearing apparatus according to claim 5 in which said means mounting said blades includes a pair of spaced pivots attaching each of said blades to said central mounting portion in spaced relation and permitting said blades to pivot along axes in the range from parallel to slightly inclined in relation to said path of vehicle travel.

9. Mine clearing apparatus comprising a vehicle, a support member supported on said vehicle, first and second elongate plough blades, means mounting said blades pivotally on said support such that each of said blades, in use, extends generally transversely of the path of travel of said vehicle in forward and rearward spaced relation to each other along said path of vehicle travel, said forward blade overlapping said path of vehicle travel, and said rearward blade terminating close to said path of vehicle travel and overlapping said forward blade, said blade pivotal mounting means including means permitting pivotal movement of each blade about a first axis extending transversely to said path of vehicle travel and a second axis substantially perpendicular to said first axis and parallel to said path of vehicle travel.

10. Mine clearing apparatus according to claim 9 in which each of said blades has a plurality of tines extending forward of the earth-engaging edge thereof.

* * * * *